US007789171B2

(12) United States Patent
Grayson et al.

(10) Patent No.: US 7,789,171 B2
(45) Date of Patent: Sep. 7, 2010

(54) DEVICE AND METHOD FOR MEASURING A PROPERTY IN A DOWNHOLE APPARATUS

(75) Inventors: William R. Grayson, Houston, TX (US); Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 191 days.

(21) Appl. No.: 11/620,928

(22) Filed: Jan. 8, 2007

(65) Prior Publication Data

US 2008/0164063 A1 Jul. 10, 2008

(51) Int. Cl.
*E21B 47/024* (2006.01)

(52) U.S. Cl. ..... 175/45; 175/40

(58) Field of Classification Search ..... 175/40, 175/45, 27

See application file for complete search history.

(56) References Cited

U.S. PATENT DOCUMENTS 4,848,144 A 7/1989 Ho
4,972,703 A 11/1990 Ho
5,044,198 A 9/1991 Ho
5,439,064 A 8/1995 Patton
6,021,377 A 2/2000 Dubinsky et al.
6,318,187 B1 11/2001 Griepentrog et al.
2004/0118612 A1 6/2004 Haci et al.
2004/0249573 A1 * 12/2004 McElhinney ..... 702/7
2005/0197777 A1 9/2005 Rodney et al.
2005/0279532 A1 * 12/2005 Ballantyne et al. ..... 175/40

OTHER PUBLICATIONS

International Search Report and Written Opinion for PCT/US 07/87135 dated Sep. 29, 2008.

* cited by examiner

*Primary Examiner*—Jennifer H Gay
*Assistant Examiner*—Brad Harcourt
(74) *Attorney, Agent, or Firm*—Howard L. Speight; Malcolm E. Whittaker

(57) ABSTRACT

A method and device for measuring a property, such as torque, includes a plurality of sensors, and a measuring device. The sensors attach to a downhole apparatus at a distance from one another. The sensors provide signals indicating their positions. A logic circuit may calculate an angle between the sensors. The logic circuit then calculates the property based on the angle, the distance between the sensors, and other known physical properties of the downhole apparatus.

16 Claims, 5 Drawing Sheets

DEVICE AND METHOD FOR MEASURING A PROPERTY IN A DOWNHOLE APPARATUS

BACKGROUND

The present invention relates to measuring a property in a downhole apparatus.

More particularly, the various embodiments of the invention are directed to measuring incremental torque between sensors and using this information to improve drilling practices.

In downhole drilling, it has become commonplace to include in the downhole apparatus one or more logging tools. This may include any number of logging-while-drilling (LWD) and measuring-while-drilling (MWD) tools, which generally have mechanical apparatuses and electrical circuits to perform specific tasks.

As those skilled in the art know, the operating environment experienced by the logging tools is very harsh. By virtue of the tools being part of the downhole apparatus, the tools experience relatively high accelerating forces due to vibration of a drill bit cutting through downhole formations. Some parameters can be measured downhole and transmitted to the surface, thereby providing a feedback system, which improves drilling efficiency and downhole tool reliability. The torque and vibration experienced may exceed specified ranges for some components that make up the downhole apparatus, thus reducing the life span of any particular electrical or mechanical device.

These problems benefit from a method for updating and/or measuring the downhole torque on the downhole apparatus and transmitting this information to the surface to improve real-time operations. A common method currently used today for measuring downhole torque utilizes strain gauges. These devices require a lengthy and complex calibration process in order for them to properly measure the torque applied to the downhole devices. Even with this calibration process these gauges drift over time causing error with the measurements and must be periodically recalibrated.

SUMMARY

The present invention provides a method and device for measuring incremental torque in a downhole apparatus.

In one embodiment of the present invention, the device comprises a first sensor and a second sensor attached to the downhole apparatus, separated by a distance and an angle. Also included is a logic circuit, which may compute the torque over the distance, based on the distance, the angle, and physical properties of the downhole apparatus.

In another embodiment of the present invention, the device also comprises additional sensors, such that the torque is calculable over various distances.

In yet another embodiment of the present invention, the sensors are magnetometers that measure the angle based on azimuths.

In a further embodiment of the present invention, the method comprises the steps of applying torque, determining the orientation of sensors, determining the distance between the sensors, and using a logic circuit, either on the surface or downhole, to determine the torque. This may occur after a step of aligning the sensors.

In another embodiment, the method does not include the step of aligning the sensors. Instead, the method includes an additional step of determining the directions of the sensors prior to the application of the torque.

DETAILED DESCRIPTION

Figure 1:
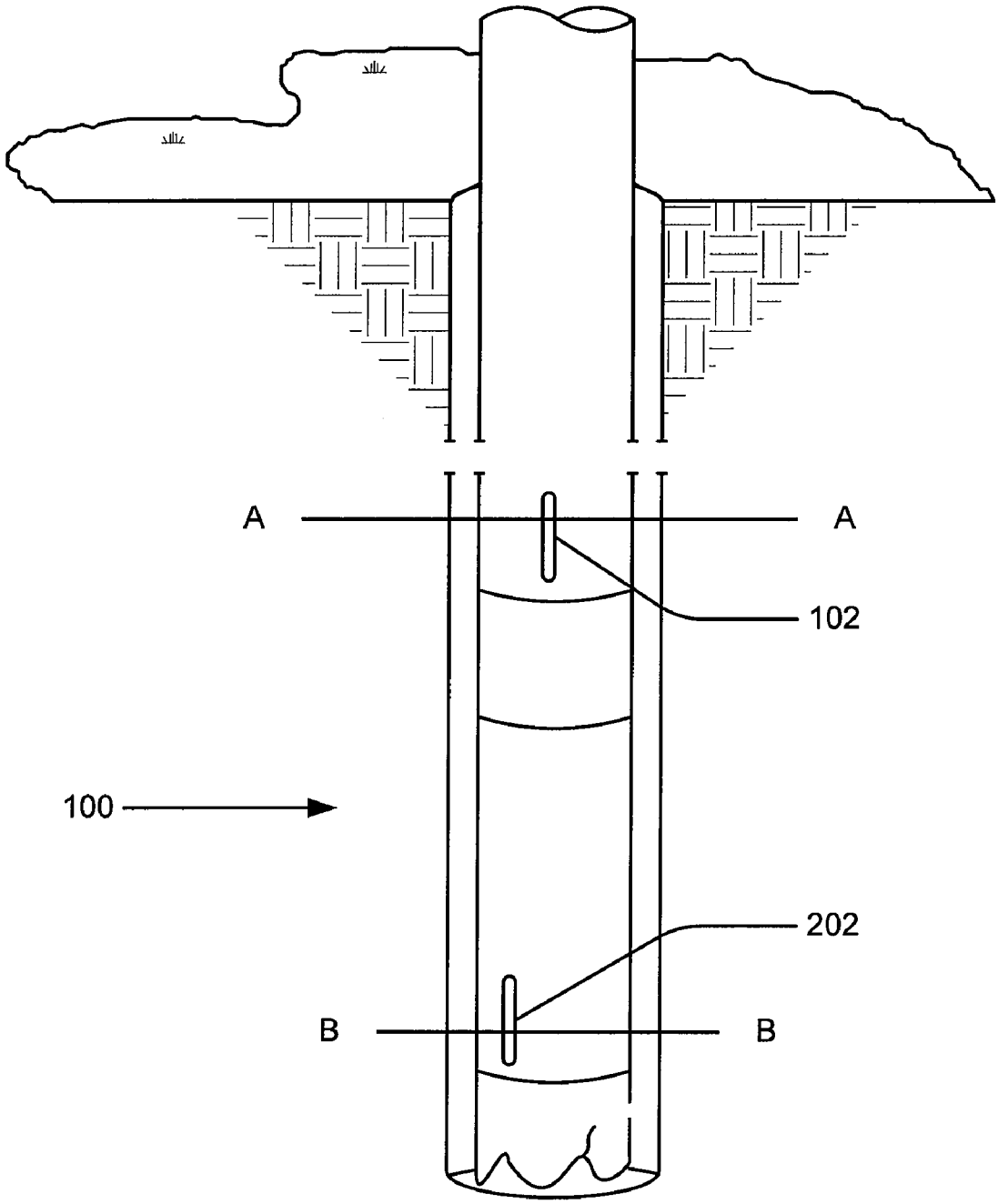
FIG. 1 is a side view of a downhole apparatus in accordance with one embodiment of the invention.

Referring to FIG. 1, shown therein is a downhole apparatus 100, having a first sensor 102 and a second sensor 202 disposed thereon. The downhole apparatus 100 may be a casing string, a pipe string, a logging tool, or anything else that may have a rotational force applied, causing it to experience an incremental torque T. As used herein, the term "incremental torque" refers to torque that is not present in an initial or base condition, the term "base torque" refers to torque that is present in the base condition, and "total torque" refers to the sum of the incremental torque and the base torque.

The downhole apparatus 100 typically has multiple components, which connect to one another by threaded connections. Frequently, the downhole apparatus 100 already includes the sensors 102, 202, such as magnetometers, which can provide information about their orientation in the drillstring. These sensors 102, 202 commonly provide information to operators regarding the orientation of the downhole apparatus 100. Additionally, the downhole apparatus 100 may have strain gauges (not shown), which are used to measure torque at the locations of the strain gauges. While torque measurements at a given location provide useful information, the strain gauges, which require calibration, may lose their calibration in the harsh conditions present in the downhole environment. The heat involved, in particular, may cause a need for frequent recalibration of the strain gauges. This is costly and time-consuming. The replacement of the strain gauge measurement with a method of measurement based on more stable sensors that are typically present in the system would improve the accuracy and greatly minimize calibration costs. By employing devices already in the downhole apparatus, no additional components would be needed to measure torque. This would result in the downhole apparatus 100 having fewer components, saving time and money and allowing for more accuracy in readings. Additionally, the strain gauge only takes measurements at a single, finite location.

The sensors 102, 202 may threadedly attach to the downhole apparatus 100 or they may otherwise attach to the downhole apparatus 100. The sensors 102, 202 may both be within a single section, the sensors 102, 202 may be in multiple sections, or the sensors 102, 202 may be distributed along the string.

Figure 3:
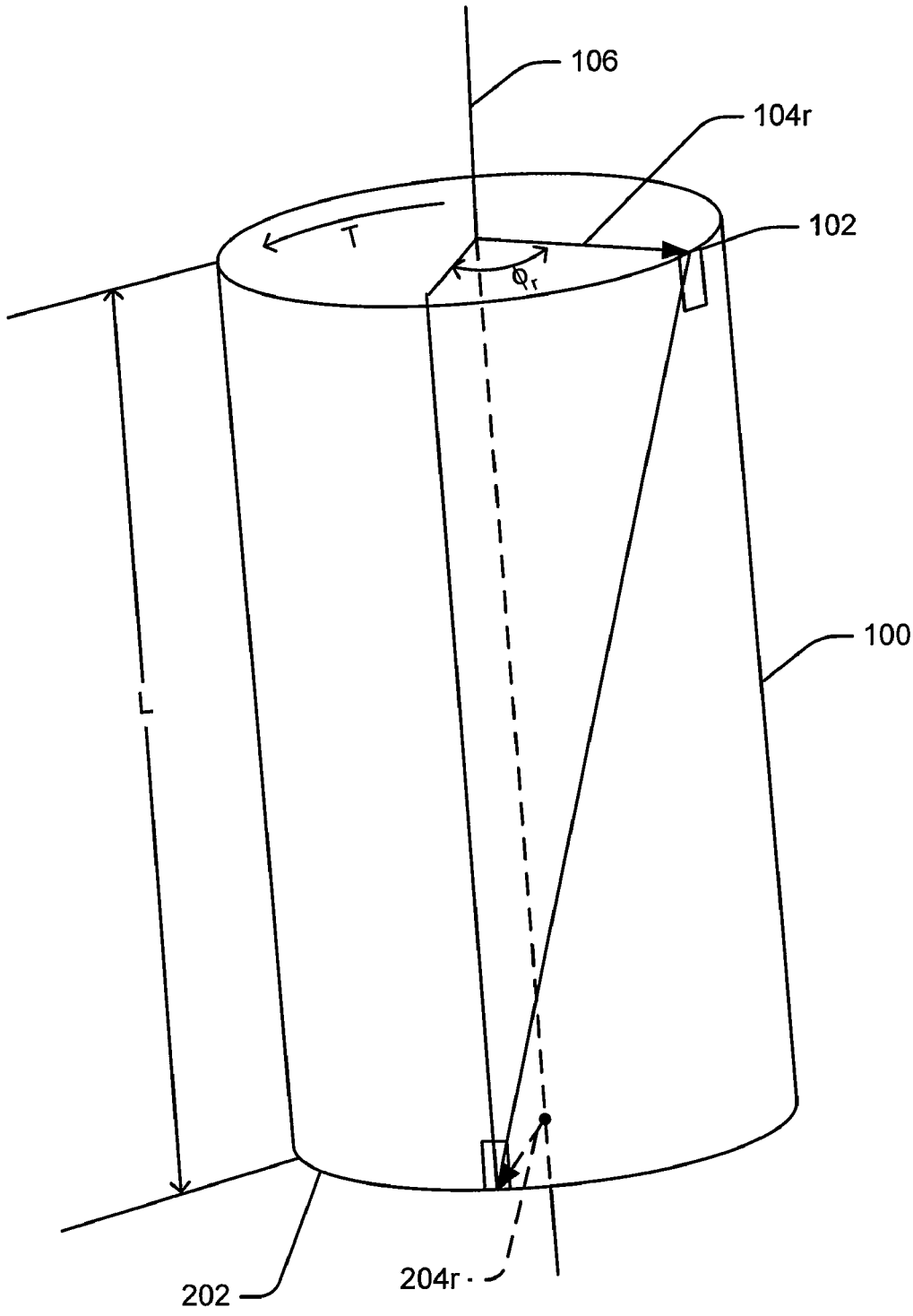
FIG. 3 is a perspective view of the downhole apparatus of FIG. 2, showing only the portion between lines AA and BB.
Figure 4:
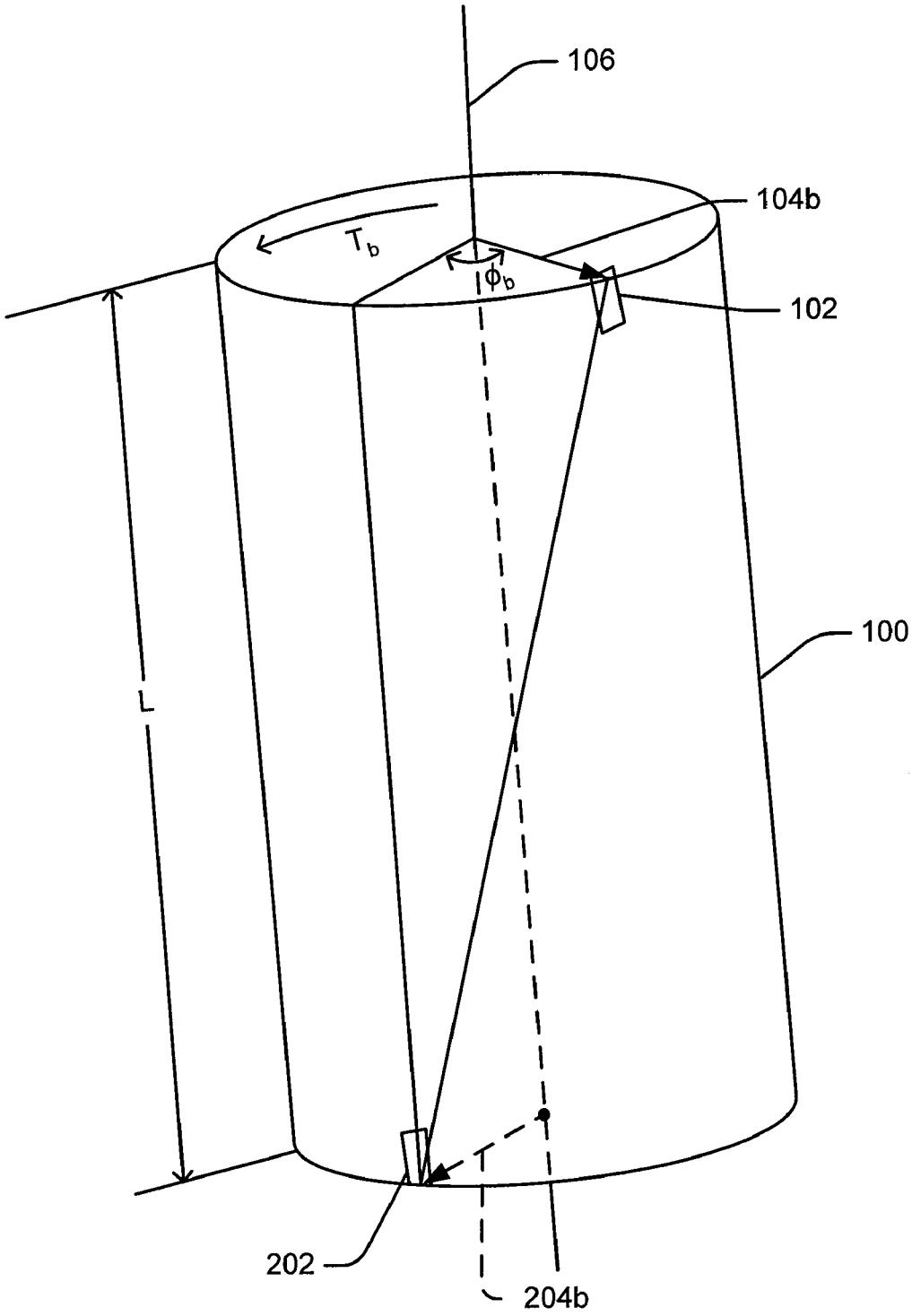
FIG. 4 is a perspective view of the downhole apparatus of FIG. 1, showing only the portion between lines AA and BB.

Regardless of the manner of attachment, the first sensor 102 and the second sensor 202 are separated by a distance L (shown in FIGS. 3 and 4). Before incremental torque T is applied, the sensors 102, 202 may initially be aligned azimuthally (not shown), or they may be offset from one another at an initial or base angle $\phi_b$ (shown in FIG. 4). When the sensors 102 and 202 azimuthally align, the base angle $\phi_b$ will separate them.

Figure 2:
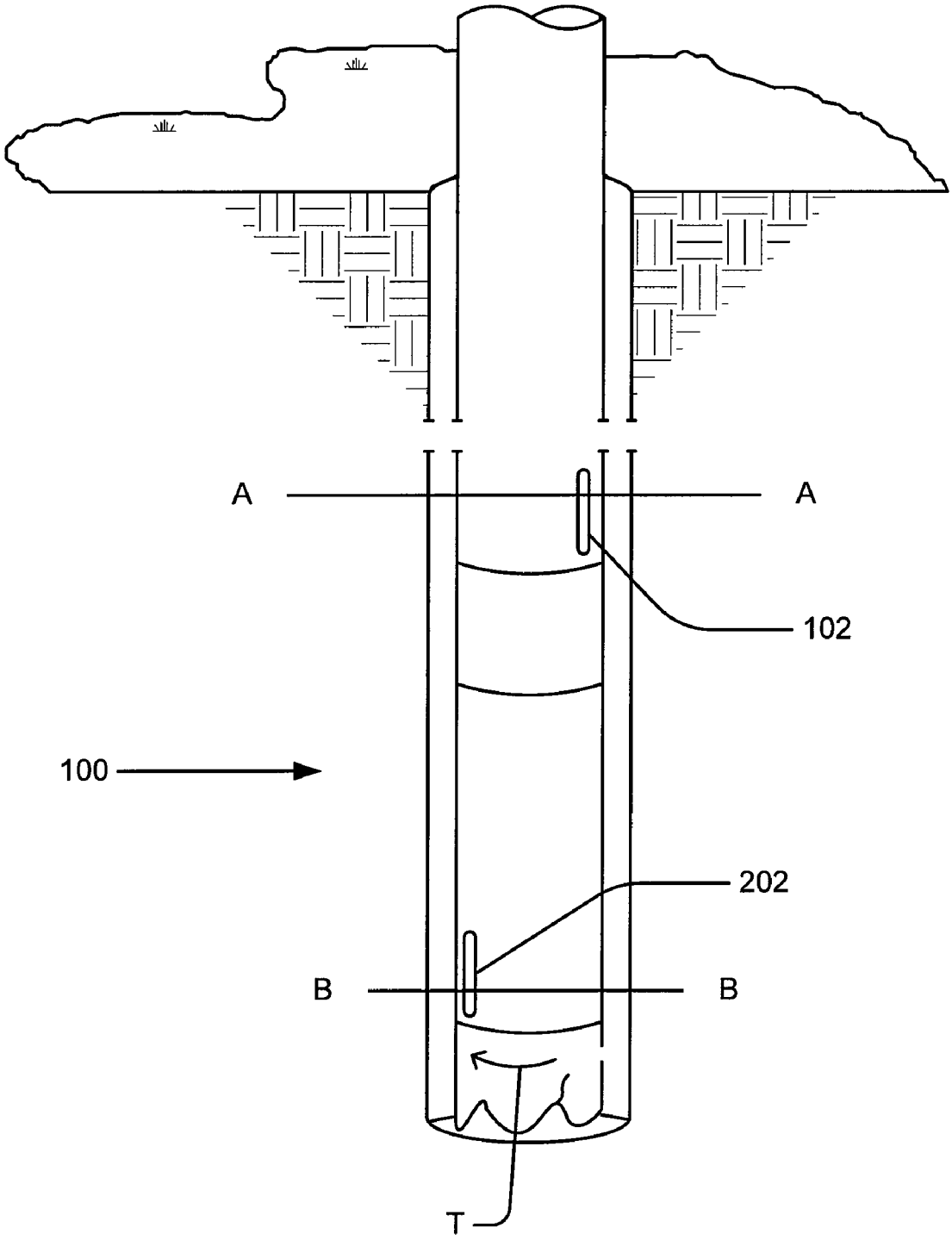
FIG. 2 is a side view of the downhole apparatus of FIG. 1, after application of an incremental torque.

FIG. 2 shows the downhole apparatus 100, with the sensors 102, 202 separated by the distance L after the incremental torque T has been applied. This distance L typically remains substantially unchanged in the presence of torque. However, the sensors 102, 202 of FIG. 2 have experienced a relative rotational movement about the downhole apparatus 100 due to the incremental torque T. The incremental torque T is the result of a rotational force applied to the apparatus 100, such as might be present in a drilling operation. The incremental torque T causes the sensors 102, 202 to be offset from one another by a resulting angle $\phi_r$ (shown in FIG. 3). The direction and the magnitude of the movement and the resulting angle $\phi_r$ will vary, depending on the incremental torque T and other factors as described below.

Referring now to FIG. 3, the incremental torque T can be calculated based on readings from at least the first sensor 102 and the second sensor 202 attached to the downhole apparatus 100. The sensors 102, 202 attach to the downhole apparatus 100, and simultaneously measure directions of a first resulting radial vector 104*r*, which corresponds to the first sensor 102, and a second resulting radial vector 204*r*, which corresponds to the second sensor 202. The incremental torque T is calculated using the equation $T=(\phi_r-\phi_b)$ G J/L, which takes into account the change in position of the sensors 102, 202 resulting from the incremental torque T. This change in position is measured by the change in angle between the sensors 102, 202, which is represented by the difference between the resulting angle $\phi_r$, and the base angle $\phi_b$. This is represented as "$(\phi_r-\phi_b)$" in the equation. The equation also uses the distance L, the polar moment of inertia J, and the material makeup G of the downhole apparatus 100 between the sensors 102 and 202.

The present invention calculates the incremental torque T in the downhole apparatus 100 using the sensors 102, 202, which may already be present in the downhole apparatus 100 for another purpose. Alternatively, the sensors 102, 202 may be present in the downhole apparatus 100 for the sole purpose of measuring incremental torque T. Each sensor 102, 202 provides an indication of which direction that sensor 102, 202 is facing relative to the downhole apparatus 100 after incremental torque T has been applied. A first resulting vector 104*r* and a second resulting vector 204*r* represent these directions. The resulting vectors 104*r*, 204*r* radiate from a centerline 106 of the downhole apparatus 100. The centerline 106 is only an imaginary reference for the resulting vectors 104*r*, 204*r*. The centerline 106 need not be vertical, or even straight. In fact, the centerline 106 may be horizontal, or it may curve at any angle.

The first resulting vector 104*r* extends perpendicularly from the centerline 106 to the first sensor 102 and the second resulting vector 204*r* extends perpendicularly from the centerline 106 to the second sensor 202. In one embodiment, the direction of the resulting vectors 104*r*, 204*r* translate to azimuths, which may represent directions defined by the projection of the Earth's magnetic field on a plane orthogonal to the drill string axis. The azimuths are not necessarily limited to magnetic azimuths, but may be an angle around the borehole that indicates the direction of maximum sensitivity of the sensors 102, 202. Likewise, vectors refer to the representative components of the constant vectors and are representative relative to the coordinate system of the tool.

The application of force resulting in the incremental torque T causes the direction of the respective sensors 102, 202 to change. However, the incremental torque T is not the only possible cause of a change in the direction of the sensors 102, 202. The direction of the sensors 102, 202 also change when the downhole apparatus 100 is rotated, even when no torque is present, i.e., when the downhole apparatus 100 rotates freely, with no constraints.

As shown in FIG. 3, it is useful to compare the direction of the first resulting vector 104*r* to the direction of the second resulting vector 204*r*, in order to determine the incremental torque T. This eliminates any influence caused by directional change resulting from free rotation, which would cause changes in the directions of the resulting vectors 104*r*, 204*r*, but which would not cause a change in the angle $\phi_r$ between them. In this manner, only directional change caused by the incremental torque T is measured.

Referring now to FIGS. 3 and 4, incremental torque T may be determined based on directional readings of the first sensor 102 and the second sensor 202. In this determination, the following equation, as stated above, is useful: $T=(\phi_r-\phi_b)$ G J/L. In this equation, T is the incremental torque. $\phi_r$ is a resulting angle formed between the first resulting vector 104*r* and the second resulting vector 204*r*. $\phi_b$ is a base angle formed between a first base vector 104*b* and a second base vector 204*b*. G is the modulus of rigidity of the portion of the downhole apparatus 100 that lies between the sensors 102 and 202. J is the polar moment of inertia of the portion of the downhole apparatus 100 that lies between the sensors 102 and 202. L is the length of the portion of the downhole apparatus 100 that lies between the sensors 102 and 202 and represents the distance between the sensors 102 and 202. L remains substantially constant when incremental torque T is applied.

The incremental torque T may have any units common to torque measurements, such as, but not limited to, Lb-in. The angles $\phi_r$, $\phi_b$ may have radians as units. However, any angular units can be used. The modulus of rigidity G is a constant that is readily ascertainable, based on the material used. Modulus of rigidity G may have units of $lb/in^2$ or any other suitable substitute. The polar moment of inertia J is a function of the cross sectional shape of the downhole apparatus 100. The polar moment of inertia J may have units of $in^4$ or any other suitable substitute. For a uniform tubular cross section, the polar moment of inertia J is equal to $\pi(d_o^4-d_i^4)/32$, where $d_o$ is the outer diameter and $d_i$ is the inner diameter of the tubular. However, the polar moment of inertia J is also readily ascertainable for a variable tubular cross section, such as that of a stabilizer. One skilled in the art could easily calculate polar moment of inertia J for a variety of shapes, as polar moment of inertia J is calculable with well-known formulas.

Figure 5A:
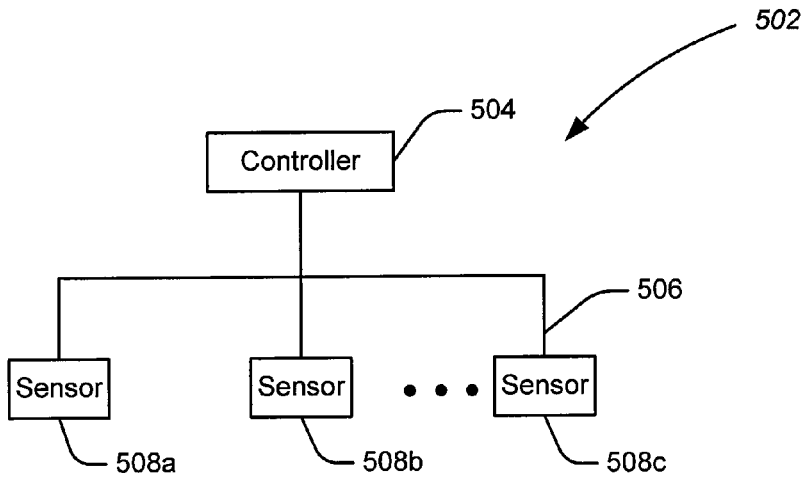
FIGS. 5A and 5B are block diagrams of a logic circuit in accordance with one embodiment of the invention.
Figure 5B:
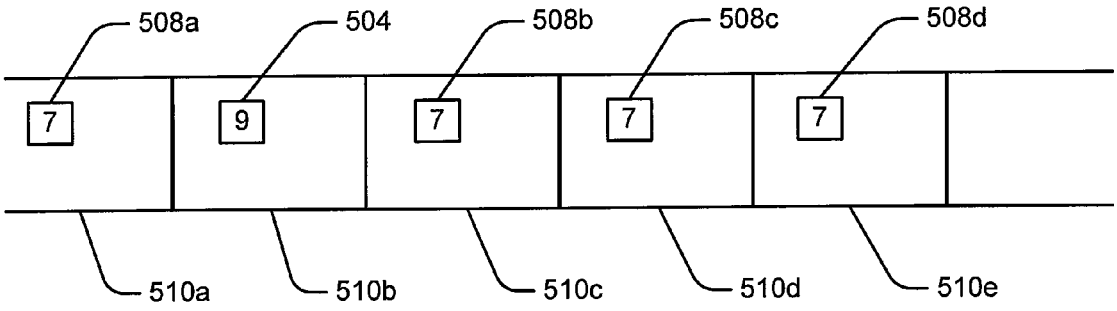

A logic circuit 502, illustrated in FIGS. 5A and 5B, may be provided to perform the calculations. The logic circuit 502 includes a processor 504, which serves as a controller processor. This controller processor 504 communicatedly connects 506 with a number of sensors 508*a*, 508*b*, 508*c* in the vicinity of the controller processor 504 downhole. Each sensor 508 may be a smart sensor, a microcontroller, or any other type of sensor known in the art. Each sensor 508 may contain its own processor coupled to a sensor, such as one of the sensors 102, 202, and may collect data from, or provide data to, the sensors. The sensor 508 may collect data from the associated sensors to transmit to the controller processor 504, which in turn gathers all of the data from the sensors 508*a*, 508*b*, 508*c*, and transmits it to the surface for processing as described herein. Alternatively, the controller processor 504 may perform the processing.

The controller 504 and sensors 508 may be distributed among elements of the drill string 510*a*, 510*b*, 510*c*, 510*d* and 510*e*, as shown in FIG. 5B.

It may be desirable to measure the incremental torque T relative to a prior, known condition. In this instance, the logic circuit 502 compares base readings with new readings obtained after a rotational force is applied. The first base vector 104*b* represents the position of the first sensor 102 before rotational force is applied, and the first resulting vector

104*r* represents the position of the first sensor 102 after application of the rotational force. Likewise, the second base vector 204*b* represents the position of the second sensor 202 before rotational force is applied, and the second resulting vector 204*r* represents the position of the second sensor 202 after application of the rotational force. Similarly, the base angle $\phi_b$ represents the angle between the first base vector 104*b* and the second base vector 204*b*, and the resulting angle $\phi_r$ represents the angle between the first resulting vector 104*r* and the second resulting vector 204*r*.

However, these various base readings are not always required. For example, the resulting angle $\phi_r$ between the first resulting vector 104*r* and the second resulting vector 204*r* may be enough to determine the incremental torque T. This condition would occur when sensors 102, 202 and thus the base vectors 104*b*, 204*b* align, or face in the same direction, prior to the application of rotational force. This causes the base angle $\phi_b$ to be equal to zero, such that the later measured resulting angle $\phi_r$ will only be associated with the incremental torque T between the first sensor 102 and the second sensor 202. Nonetheless, it is not always practical or desirable to set the sensors 102, 202 in the same direction while refraining from applying a rotational force. The base angle $\phi_b$ may also be measured prior to tripping into the borehole or the base angle $\phi_b$ may be measured at a time when the tool is stationary.

When the first base vector 104*b* and the second base vector 204*b* do not align, the incremental torque T may still be easily calculated. This is particularly useful when already present components of the downhole apparatus 100 function as the sensors 102, 202. For example, magnetometers are commonly present on the downhole apparatus 100 and can provide information useful for calculating incremental torque T. The ability to calculate the incremental torque T without the need for alteration of existing components saves both time and money.

In this instance, the base angle $\phi_b$ between the first base vector 104*b* and the second base vector 204*b* is calculated. This may occur at any time during the downhole operation, such as when the drilling operation is stopped for pipe connections, maintenance or retooling. After recordation of the base angle $\phi_b$, rotational force is applied, causing the resulting angle $\phi_r$ between the first resulting vector 104*r* and the second resulting vector 204*r*. In order to determine the incremental torque T, the base angle $\phi_b$ is subtracted from the resulting angle $\phi_r$ in the equation above.

As discussed above, the incremental torque T can be calculated without first aligning the sensors 102, 202, or incremental torque T can be calculated by comparing the base angle $\phi_b$ with the resulting angle $\phi_r$. Additionally, the incremental torque T can be calculated when the base conditions additionally include an already present known base torque Tb. This allows the incremental torque T to be calculated without stopping the operation, so long as the base torque Tb is known. The known base torque Tb may be zero (representing no torque at all), or it may be any other known measurement. If a total torque $T_{tot}$ is required, it can be easily calculated by summing the base torque Tb and the incremental torque T. When there is no base torque Tb, the total torque $T_{tot}$ will be equal to the incremental torque T. It should be noted that the quantity $(\phi_r-\phi_b)$ indicates the movement of the sensors 102, 202 from a position indicated by base vectors 104*b*, 204*b* to a position indicated by resulting vectors 104*r*, 204*r* as a result of the incremental torque T. Therefore, one of ordinary skill in the art will be able to modify this equation to accommodate conditions resulting in negative numbers or any other special circumstances.

In this manner, the incremental torque T can be determined between any two sensors 102, 202, so long as either of two conditions are met: (1) the sensors 102, 202 are aligned such that their respective base vectors 104*b*, 204*b* have the same direction, or (2) the base angle $\phi_b$ corresponding to a known base torque Tb is recorded.

Each sensor 102, 202 may have one or more magnetometers, or any other device capable of measuring the resulting vectors 104*r*, 204*r* or the base vectors 104*b*, 204*b*. Since magnetometers lose accuracy when the field of measurement is nulled, a single magnetometer may not perform optimally in, for example, a direction of drilling that would cause the sensing field to be minimized. In this instance, multiple devices may be included within the sensors 102, 202. For example, each sensor 102, 202 may include a magnetometer, a gyro device, a gravity device, or any other type of device that measures orientation. These measurements may be taken based on magnetic fields, gravity, or the earth's spin axis. This may allow for directional readings in any position. Multiple devices may also be used to check the measurements of one another. Additionally, the sensors 102, 202 may indicate the quantity $(\phi_r-\phi_b)$ by any method, either with or without the use of vectors 104*b*, 104*r*, 204*b*, 204*r* radiating from the centerline 106. For example, the sensors 102, 202 may indicate relative position by sonic ranging, north seeking gyros, multiple directional instruments, or any other means capable of communicating the position of the first sensor 102 relative to the second sensor 202. The sensors 102, 202 may attach to the downhole apparatus 100 in any position. Since the quantity $\phi_r-\phi_b)$ can be measured at any point outside the centerline 106, the sensors 102, 202 may be on an inside surface, an outside surface, or within a wall of the downhole apparatus 100. Additionally, the sensors 102, 202 may threadedly attach at threaded ends of a section, or the sensors 102, 202 may be an integral part of the downhole apparatus 100.

Each sensor 102, 202 may provide a signal to indicate its position and orientation. This may be done via the logic circuit 502. The logic circuit 502 may then calculate the incremental torque T between any two sensors 102, 202. This calculation may be an average reading over a period of time, or it may be at a single measured point in time. Since the incremental torque T may vary along the length, it may be desirable to have additional sensors (not shown). In the event that additional sensors are used, multiple sectional incremental torque readings are calculable. This is useful during drilling operations. Due to the length of the typical downhole apparatus 100, it is common that the incremental torque T varies along the length. This may occur, for example, when a portion of the downhole apparatus 100 rubs against a formation, or otherwise experiences binding. This may cause a very low incremental torque in one portion of the downhole apparatus 100, while causing another portion of the same downhole apparatus 100 to experience very high incremental torque. As one of ordinary skill in the art can appreciate, this is undesirable for a number of reasons, including bit stick/slip.

When more than two sensors are used, the methods described above may be used between any two sensors, resulting in a number of incremental torque T readings that exceeds the number of sensors. For example, four sensors could give six readings. Say these sensors are called A, B, C, and D (not shown). Readings are calculable between A and B; A and C; A and D; B and C; B and D; C and D. While some of these readings would appear redundant, these multiple readings are useful to check or calibrate the incremental torque T readings during operation, without the need to cease operations.

During a downhole operation, many measurements may be taken and averaged or otherwise analyzed to find the incremental torque T. These measurements may reflect a constant incremental torque, or these measurements may reflect a changing incremental torque. One skilled in the art will recognize that the number of measurements necessary for statistical accuracy may vary, depending on the actual conditions.

Likewise, measurements may be used to determine other data. For example, tortuosity may be measured by taking multiple shots over time, giving the shape of the borehole. This can be used to build a model for drilling efficiency and can assist in getting the casing into the borehole. Additionally, monitoring tortuosity may allow the driller to straighten out the borehole. In another example, dogleg severity, or the limit of angle of deflection, can be determined using multiple samples over time to provide information on stresses that the drillstring is experiencing. This would allow for a determination as to whether the tool is being pushed beyond recommended limits. Additionally, bending can be measured with a device, such as an accelerometer. The bending measurement may be a one-time sample. While a bending radius can be inferred from any bending measurement, samples over time may give a more accurate bending radius. Other examples of measurements include stick slip, sticking, and the like.

The sensors 102, 202 can also be useful in determining problems, such as, but not limited to inelastic deformation, and unscrewing. For instance, if the sensors 102, 202 are separated across one or more joints, and the offset between the sensors 102, 202 changes significantly, there is a high likelihood that something has gone wrong. Additionally, the sensors 102, 202 may be used on a deliberately bent assembly to ensure that the bend is still proper, or for other purposes. The sensors 102, 202 may also be used with motors and rotary steerables to validate that the build angle is matching the well plan.

In addition to measuring changes in conditions, multiple samples may be used to correct noise in sampling. This may be done using e.g. a "burst" sample.

Measurements may be taken using differential change in measured magnetic tool face. For example, this may begin with the transformation from Earth coordinates to tool coordinates, where BN is the North component of the Earth's magnetic field, BV is the vertical component (and by definition, the East component is 0), and where Bx1, By1, and Bz1 are the respective x, y, and z components of the observed magnetic field at magnetometer 1. Likewise Bx2, By2, and Bz2 are the respective x, y, and z components of the observed magnetic field at magnetometer 2. ρ1 is the magnetic tool face at magnetometer 1, and ρ2 is the magnetic tool face at magnetometer 2.

In General:

$$\begin{pmatrix} Bx \\ By \\ Bz \end{pmatrix} = \begin{pmatrix} \mathrm{Cos}[\theta]\mathrm{Cos}[\phi]\mathrm{Cos}[\psi] - \mathrm{Sin}[\phi]\mathrm{Sin}[\psi] & \mathrm{Cos}[\psi]\mathrm{Sin}[\phi] + \mathrm{Cos}[\theta]\mathrm{Cos}[\phi]\mathrm{Sin}[\psi] & -\mathrm{Cos}[\phi]\mathrm{Sin}[\theta \\ -\mathrm{Cos}[\theta]\mathrm{Cos}[\psi]\mathrm{Sin}[\phi] - \mathrm{Cos}[\phi]\mathrm{Sin}[\psi] & \mathrm{Cos}[\phi]\mathrm{Cos}[\psi] - \mathrm{Cos}[\theta]\mathrm{Sin}[\phi]\mathrm{Sin}[\psi] & \mathrm{Sin}[\theta]\mathrm{Sin}[\phi] \\ \mathrm{Cos}[\psi]\mathrm{Sin}[\theta] & \mathrm{Sin}[\theta]\mathrm{Sin}[\psi] & \mathrm{Cos}[\theta] \end{pmatrix} \cdot \begin{pmatrix} BN \\ 0 \\ BV \end{pmatrix}$$

From which $$\begin{pmatrix} Bx \\ By \\ Bz \end{pmatrix} = \begin{pmatrix} -BV\mathrm{Cos}[\phi]\mathrm{Sin}[\theta] + BN(\mathrm{Cos}[\theta]\mathrm{Cos}[\phi]\mathrm{Cos}[\psi] - \mathrm{Sin}[\phi]\mathrm{Sin}[\psi]) \\ BV\mathrm{Sin}[\theta]\mathrm{Sin}[\phi] + BN(-\mathrm{Cos}[\theta]\mathrm{Cos}[\psi]\mathrm{Sin}[\phi] - \mathrm{Cos}[\phi]\mathrm{Sin}[\psi]) \\ BV\mathrm{Cos}[\theta] + BN\mathrm{Cos}[\psi]\mathrm{Sin}[\theta] \end{pmatrix}$$

The formula below may be used to calculate two magnetic tool face values. While this may be defined in any number of ways, the choice should not significantly affect the result.

$$\phi = \mathrm{ArcTan}\,[-Bx, By]$$

Where arctan is the four quadrant arctan, with quadrant information derived from the algebraic signs of the x and y terms.

So that:

$$\phi 1 = \mathrm{ArcTan}\,[BV\,\mathrm{Cos}\,[\phi 1]\,\mathrm{Sin}\,[\theta 1] - BN(\mathrm{Cos}\,[\theta 1]\,\mathrm{Cos}\,[\phi 1]\,\mathrm{Cos}\,[\psi 1] + \mathrm{Sin}\,[\phi 1]\,\mathrm{Sin}\,[\psi 1]), BV\,\mathrm{Sin}\,[\theta 1]\,\mathrm{Sin}\,[\phi 1] + BN(-\mathrm{Cos}\,[\theta 1]\,\mathrm{Cos}\,[\psi 1]\,\mathrm{Sin}\,[\phi 1] - \mathrm{Cos}\,[\phi 1]\,\mathrm{Sin}\,[\psi 1])]$$

$$\phi 2 = \mathrm{ArcTan}\,[BV\,\mathrm{Cos}\,[\phi 2]\,\mathrm{Sin}\,[\theta 2] - BN(\mathrm{Cos}\,[\theta 2]\,\mathrm{Cos}\,[\phi 2]\,\mathrm{Cos}\,[\psi 2] + \mathrm{Sin}\,[\phi 2]\,\mathrm{Sin}\,[\psi 2])], BV\,\mathrm{Sin}\,[\theta 2]\,\mathrm{Sin}\,[\phi 2] + BN(-\mathrm{Cos}\,[\theta 2]\,\mathrm{Cos}\,[\psi 2]\,\mathrm{Sin}\,[\phi 2] - \mathrm{Cos}\,[\phi 2]\,\mathrm{Sin}\,[\psi 2])]$$

Defining the dip angle as D:

$$BV = Bt * \mathrm{Sin}[D]$$

$$BN = Bt * \mathrm{Cos}[D]$$

$$P1 = \mathrm{ArcTan}\left[\frac{\mathrm{Cos}[\theta 1]\mathrm{Cos}[\psi 1] - \mathrm{Sin}[\theta 1]\mathrm{Tan}[D]}{\mathrm{Sin}[\psi 1]} + \mathrm{Tan}[\phi 1],\ 1 - \frac{(-\mathrm{Cos}[\theta 1]\mathrm{Cos}[\psi 1] + \mathrm{Sin}[\theta 1]\mathrm{Tan}[D])}{\mathrm{Sin}[\psi 1]}\mathrm{Tan}[\phi 1]\right]$$

Let:

$$\mathrm{Tan}[\alpha 1] = \frac{\mathrm{Cos}[\theta 1]\mathrm{Cos}[\psi 1] - \mathrm{Sin}[\theta 1]\mathrm{Tan}[D]}{\mathrm{Sin}[\psi 1]}$$

So that:

$$\phi 1 = \mathrm{ArcTan}\,[\mathrm{Tan}\,[\alpha 1] + \mathrm{Tan}\,[\phi 1], 1 - \mathrm{Tan}\,[\alpha 1]\,\mathrm{Tan}\,[\phi 1]]$$
$$\phi 1 = \phi 1 + \alpha 1$$

Similarly:

$$\phi 2 = \phi 2 + \alpha 2$$

Where:

$$\mathrm{Tan}[\alpha 2] = \frac{\mathrm{Cos}[\theta 2]\mathrm{Cos}[\psi 2] - \mathrm{Sin}[\theta 2]\mathrm{Tan}[D]}{\mathrm{Sin}[\psi 2]}$$

The quantity of interest is:

$$\phi 2 - \phi 1 = (\phi 2 - \phi 1) + (\alpha 2 - \alpha 1)$$

This equation illustrates an important point: In order to calculate a specific torque (i.e. a torque about the drillstring axis, or a bending moment), it is sometimes necessary to decouple the available measurements. The equations given here indicate when this is necessary in the case of measurements made with magnetometers and inclinators, and they show how the decoupling is effected. This is further illustrated in cases 1-4 below. If other types of sensors are used, similar equations can be derived, as will be evident to one skilled in the art.

Case 1

When there is constant inclination and azimuth, only the tool face may vary. In this case, $\alpha 2=\alpha 1$, and the change in magnetic tool face equals the change in gravitational tool face. If there is a change in inclination or azimuth, a change in dip is not expected, except via noise.

Case 2

When there is constant azimuth, the inclination and tool face may vary. In this case, working first with inclination, suppose $\theta 2=\theta 1+\delta\theta$, and dropping second order terms:

$$\mathrm{Tan}[\alpha 2]=\frac{\mathrm{Cos}[\theta 1]\mathrm{Cos}[\psi 2]-\mathrm{Sin}[\theta]\mathrm{Tan}[D]+\delta\theta(-\mathrm{Cos}[\psi 2]\mathrm{Sin}[\theta 1]-\mathrm{Cos}[\theta 1]\mathrm{Tan}[D])}{\mathrm{Sin}[\psi 2]}$$

So that:

$$\mathrm{Tan}[\alpha 2-\alpha 1]=\frac{\mathrm{Tan}[\alpha 2]-\mathrm{Tan}[\alpha 1]}{1+\mathrm{Tan}[\alpha 2]*\mathrm{Tan}[\alpha 1]}$$

$$\mathrm{Tan}[\alpha 2]-\mathrm{Tan}[\alpha 1]=\frac{\mathrm{Cos}[\theta 1]\mathrm{Cos}[\psi 2]-\mathrm{Sin}[\theta 1]\mathrm{Tan}[D]+\delta\theta(-\mathrm{Cos}[\psi 2]\mathrm{Sin}[\theta 1]-\mathrm{Cos}[\theta 1]\mathrm{Tan}[D])}{\mathrm{Sin}[\psi 2]}-\frac{\mathrm{Cos}[\theta 1]\mathrm{Cos}[\psi 1]-\mathrm{Sin}[\theta 1]\mathrm{Tan}[D]}{\mathrm{Sin}[\psi 1]}$$

But, the assumption in this case is that $\psi 2=\psi 1$, so $$\mathrm{Tan}[\alpha 2-\alpha 1]=-\delta\theta(\mathrm{Cot}[\psi 1]\,\mathrm{Sin}[\theta 1]+\mathrm{Cos}[\theta 1]\,\mathrm{Csc}[\psi 1]\,\mathrm{Tan}[D])$$

Or, to the small angle approximation:

$$\alpha 2-\alpha 1=-\delta\theta(\mathrm{Cot}[\psi 1]\,\mathrm{Sin}[\theta 1]+\mathrm{Cos}[\theta 1]\,Csc[\psi 1]\,\mathrm{Tan}[D])$$

There is, therefore, the potential that small changes in inclination will, at small azimuths, make a significant contribution to $\rho 2-\rho 1$.

Case 3

When there is constant inclination, the azimuth and tool face may vary. In this case, $\theta 2=\theta 1$, but $\psi 2=\psi 1+\delta\psi$. With the same type of reasoning, it can be shown that in the differential limit:

$$\alpha 2-\alpha 1=-\delta\psi\mathrm{Csc}[\psi 1(\mathrm{Cos}[\theta 1]\,\mathrm{Csc}[\psi 1]-\mathrm{Cot}[\psi 1]\,\mathrm{Sin}[\theta 1]\,\mathrm{Tan}[D])$$

With $\sin[\theta 1]=\cos[D]$, and $\cos[\theta 1]=\sin[D]$, then:

$$\alpha 2-\alpha 1=-\delta\psi\mathrm{Csc}[\psi 1]\,(\mathrm{Sin}[D]\,\mathrm{Csc}[\psi 1]-\mathrm{Cot}[\psi 1]\,\mathrm{Sin}[D])$$

So that as $\psi 1\rightarrow 0$, i.e. as the trajectory aligns with the Earth's magnetic field, this term vanishes. However, the magnetic tool face is not defined under this condition.

Case 4

When inclination azimuth and tool face vary, in the small angle approximation, the previous results can be combined to obtain:

$$\alpha 2-\alpha 1=-\delta\theta(\mathrm{Cot}[\psi 1]\,\mathrm{Sin}[\theta 1]\rightarrow\mathrm{Cos}[\theta 1]\,\mathrm{Csc}[\psi 1]\,\mathrm{Tan}]D])-\delta\psi\mathrm{Csc}[\psi 1]\,\mathrm{Sin}[D]\,\mathrm{Csc}[\psi 1-\mathrm{Cot}[\psi 1\,\mathrm{Sin}[D])$$

Or:

$$\phi 2-1=\delta\phi-\delta\theta(\mathrm{Cot}[\psi 1]\,\mathrm{Sin}[\theta 1]+\mathrm{Cos}[\theta 1]\,\mathrm{Csc}[\psi 1]\,\mathrm{Tan}[D])-\delta\psi\mathrm{Csc}[\psi 1]\,(\mathrm{Sin}[D]\,\mathrm{Csc}[\psi 1]-\mathrm{Cot}[\psi 1]\,\mathrm{Sin}[D])$$

Note that torque is preferably inferred using $\delta\phi$, not $\delta\rho=\rho 2-\rho 1$.

Therefore, if a lot of change is expected in inclination and/or azimuth, in addition to the change in magnetic tool face, the inclination and azimuth is desirably measured at both points where the magnetic tool face is measured. It may be advantageous under these conditions to use the gravitational readings instead of the magnetic field readings.

Measurements may also be taken using differential change in gravitational tool face. Because gravity simply points down, the transformation of the gravitational field from NEV to tool coordinates is much simpler. gx1, gy1, and gz1 are the respective x, y, and z components of the observed gravitational field at accelerometer 1. Likewise gx2, gy2, and gz2 are the respective x, y, and z components of the observed gravitational field at accelerometer 2. $\rho 1$ is the magnetic tool face at magnetometer 1, and $\rho 2$ is the magnetic tool face at magnetometer 2. $\phi 1$ is the gravitational tool face at accelerometer 1 and $\phi 2$ is the gravitational tool face at accelerometer 2.

In general:

$$\begin{pmatrix} gx \\ gy \\ gz \end{pmatrix}=\begin{pmatrix} \mathrm{Cos}[\theta]\mathrm{Cos}[\phi]\mathrm{Cos}[\psi]-\mathrm{Sin}[\phi]\mathrm{Sin}[\psi] & \mathrm{Cos}[\psi]\mathrm{Sin}[\phi]+\mathrm{Cos}[\theta]\mathrm{Cos}[\phi]\mathrm{Sin}[\psi] & -\mathrm{Cos}[\phi]\mathrm{Sin}[\theta \\ -\mathrm{Cos}[\theta]\mathrm{Cos}[\psi]\mathrm{Sin}[\phi]-\mathrm{Cos}[\phi]\mathrm{Sin}[\psi] & \mathrm{Cos}[\phi]\mathrm{Cos}[\psi]-\mathrm{Cos}[\theta]\mathrm{Sin}[\phi]\mathrm{Sin}[\psi] & \mathrm{Sin}[\theta]\mathrm{Sin}[\phi] \\ \mathrm{Cos}[\psi]\mathrm{Sin}[\theta] & \mathrm{Sin}[\theta]\mathrm{Sin}[\psi] & \mathrm{Cos}[\theta] \end{pmatrix}\cdot\begin{pmatrix} 0 \\ 0 \\ g \end{pmatrix}$$

Where g is the magnitude of the gravitational field:

$$g=\sqrt{gx^2+gy^2+gz^2}$$

$$\begin{pmatrix} gx \\ gy \\ gz \end{pmatrix}=g\begin{pmatrix} -\mathrm{Sin}[\theta]\mathrm{Cos}[\phi] \\ \mathrm{Sin}[\theta]\mathrm{Sin}[\phi] \\ \mathrm{Cos}[\theta] \end{pmatrix}$$

Therefore, except when $\theta=0$ or $\theta=\pi$:

$$\phi=\mathrm{ArcTan}[-gx,gy]$$

And is independent of the inclination or the azimuth. Therefore, $\phi 2-\phi 1$ is independent of changes in the inclination or azimuth, so that changes in gravitational tool face can be used directly to measure torque.

Since gz is independent of the tool face, a bending moment can be measured using changes in the inclination. A change in inclination is reflected by a deflection in a vertical plane containing the well trajectory (at least locally).

In general, there will also be a second bending moment for deflections of the drillstring orthogonal to a vertical plane containing the well trajectory (locally). An azimuth change is associated with this deflection, but is not sufficient by itself to calculate the desired bending moment since the torque acts along the tool axis, whereas the azimuth change is defined as a rotation towards North.

Assuming there is no magnetic interference:

$$\psi=\mathrm{ArcTan}[(Bx*\mathrm{Cos}\,[\psi]-By*\mathrm{Sin}\,[\phi])*\mathrm{Cos}\,[\theta]+Bz*\mathrm{Sin}\,[\theta],-(Bx*\mathrm{Sin}\,[\phi]+By*\mathrm{Cos}\,[\phi])]$$

The azimuth can often be calculated in the presence of magnetic interference, but the techniques used are considerably more complicated. A similar analysis can be carried out with them, but with considerable complexity. Adding suffixes 1 and 2 for measurements made at locations 1 and 2 gives:

$$\psi1=\mathrm{ArcTan}\,[(Bx1*\mathrm{Cos}\,[\phi1]-By1*\mathrm{Sin}\,[\psi1])*\mathrm{Cos}\,[\theta1]+Bz1*\mathrm{Sin}\,[\theta1],-(Bx1*\mathrm{Sin}\,[\phi1]+By1*\mathrm{Cos}\,[\phi1])]$$

$$\psi2=\mathrm{ArcTan}\,[(Bx2*\mathrm{Cos}\,[\phi2]-By2*\mathrm{Sin}\,[\phi2])*\mathrm{Cos}\,[\theta2]+Bz2*\mathrm{Sin}\,[\theta2],-(Bx2*\mathrm{Sin}\,[\phi2+By2*\mathrm{Cos}\,[\phi2])]$$

The angular change $\delta\psi=\psi2-\psi1$ could be used to define a bending moment, but it is desirable to equate this to a deflection of the drillstring in a direction generally perpendicular to a vertical plane tangent to the trajectory at either measurement point 1 or measurement point 2. This deflection, called $\delta\zeta$, can be calculated considering that the change in azimuth is the projection of the sought deflection on the horizontal plane. Therefore, the desired angular deflection, assuming that the change in inclination between the two survey points is small compared to the inclination itself, is:

$$\delta\zeta=(\psi2-\psi1)*\mathrm{Sin}\left[\frac{\theta1+\theta2}{2}\right]$$

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A system for measuring a property of a downhole apparatus over a longitudinal extent of the downhole apparatus, the system comprising:

a first sensor coupled to the downhole apparatus at a first location, the first sensor providing an output which is a measure of an orientation of the downhole apparatus at the first location;

a second sensor coupled to the downhole apparatus at a second location, the second sensor providing an output which is a measure of an orientation of the downhole apparatus at the second location;

a device for:

accepting A=the output of the first sensor representing the orientation of the downhole apparatus at the first location at a first time and B=the output of the first sensor representing the orientation of the downhole apparatus at the first location at a second time, the second time being later than the first time;

accepting C=the output of the second sensor representing the orientation of the downhole apparatus at the second location at the first time and D=the output of the second sensor representing the orientation of the downhole apparatus at the second location at the second time;

determining an angle $\phi_b$ between A and C;

determining an angle $\phi_r$ between B and D; and computing the property of the downhole apparatus using $\phi_b$ and $\phi_r$.

2. The system of claim 1, wherein the longitudinal extent is between the first location on the downhole apparatus and the second location on the downhole apparatus and the property is the difference in torque applied to the longitudinal extent between the first time and the second time.

3. A system for measuring a property of a downhole apparatus over a longitudinal extent of the downhole apparatus, the system comprising:

a first sensor coupled to the downhole apparatus at a first location, the first sensor providing an output which is a measure of an orientation of the downhole apparatus at the first location;

a device for computing the property of the downhole apparatus over the longitudinal extent by:

computing a first difference between the orientation of the downhole apparatus at a first time and a first reference orientation;

computing the property using the first difference and a reference difference determined at a second time, the second time being before the first time.

4. The system of claim 3, wherein the reference difference comprises the difference between the orientation of the downhole apparatus at the first location and a second reference orientation at the second time.

5. The system of claim 4 further comprising:

a second sensor coupled to the downhole apparatus at a second location;

the second sensor providing an output at the first time which is a measure of the first reference orientation; and the second sensor providing an output at the second time which is a measure of the second reference orientation.

6. The system of claim 5 wherein the longitudinal extent is between the first location on the downhole apparatus and the second location on the downhole apparatus and the property is the difference in torque applied to the longitudinal extent between the first time and the second time.

7. The system of claim 3, wherein the property comprises torque.

8. The system of claim 3, wherein the property comprises bending.

9. The system of claim 3, wherein the property is further computed using the first time and the second time.

10. A method of improving drilling efficiency, comprising:

drilling with a downhole apparatus;

providing a first sensor coupled to the downhole apparatus at a first location, the first sensor providing an output which is a measure of an orientation of the downhole apparatus at the first location;

providing a second sensor coupled to the downhole apparatus at a second location, the second sensor providing an output which is a measure of an orientation of the downhole apparatus at the second location;

computing the property of the downhole apparatus over the longitudinal extent by:

sampling the output of the first sensor and the output of the second sensor at a series of times;

calculating torque on the longitudinal extent over time using the sampled outputs of the first sensor and the second sensor; and calculating the derivative of the calculated torque.

11. The method of claim 10, further comprising adjusting the drilling based on the calculated derivative.

12. The method of claim 10, further comprising adjusting a survey compiled during drilling based on the calculated derivative.

13. A system for measuring a property over a longitudinal extent of a downhole apparatus, comprising:

a first sensor coupled to the downhole apparatus at a first location, the first sensor providing an output which is a measure of an orientation of the downhole apparatus at the first location;

a second sensor coupled to the downhole apparatus at a second location, the second sensor providing an output which is a measure of an orientation of the downhole apparatus at the second location;

a device for computing the property of the downhole apparatus over the longitudinal extent by:

sampling the output of the first sensor and the output of the second sensor at a series of times;

calculating torque on the longitudinal extent over time using the sampled outputs of the first sensor and the second sensor; and calculating the derivative of the calculated torque.

14. A system for measuring a property over a longitudinal extent of a downhole apparatus, comprising:

a downhole apparatus with adjustable drilling parameters;

a first sensor coupled to the downhole apparatus at a first location, the first sensor providing an output which is a measure of an orientation of the downhole apparatus at the first location;

a second sensor coupled to the downhole apparatus at a second location, the second sensor providing an output which is a measure of an orientation of the downhole apparatus at the second location;

a device for computing the property of the downhole apparatus over the longitudinal extent by:

sampling the output of the first sensor and the output of the second sensor at a series of times;

calculating torque on the longitudinal extent over time using the sampled outputs of the first sensor and the second sensor; and calculating the derivative of the calculated torque.

15. The system of claim 14, further comprising a device for adjusting the drilling based on the calculated derivative.

16. The method of claim 14, further comprising a device for adjusting a survey compiled during drilling based on the calculated derivative.

* * * * *